US009302796B2

(12) United States Patent
Averett

(10) Patent No.: US 9,302,796 B2
(45) Date of Patent: Apr. 5, 2016

(54) LONG-TERM PACKAGING OF FOOD FOR CONSUMER USE

(75) Inventor: Kristi Bina Averett, Gilbert, AZ (US)

(73) Assignee: FoodWise TRN, LLC, Chandler, AZ (US)

( * ) Notice: Subject to any disclaimer, the term of this patent is extended or adjusted under 35 U.S.C. 154(b) by 1049 days.

(21) Appl. No.: 13/220,409

(22) Filed: Aug. 29, 2011

(65) Prior Publication Data

US 2012/0048825 A1 Mar. 1, 2012

Related U.S. Application Data

(60) Provisional application No. 61/378,750, filed on Aug. 31, 2010.

(51) Int. Cl.

| | |
|---|---|
| ***B65B 7/28*** | (2006.01) |
| ***B65D 41/04*** | (2006.01) |
| ***B65D 53/04*** | (2006.01) |
| ***B65B 51/22*** | (2006.01) |
| ***B65B 55/19*** | (2006.01) |
| ***B65D 81/26*** | (2006.01) |

(52) U.S. Cl.

CPC ..... *B65B 7/2835* (2013.01); *B65B 51/227* (2013.01); *B65B 55/19* (2013.01); *B65D 41/045* (2013.01); *B65D 53/04* (2013.01); *B65D 81/266* (2013.01)

(58) Field of Classification Search

CPC .... B65D 51/22; B65D 51/20; B65D 77/2024; B65D 77/2068; B65D 77/20; B65D 17/502; B65D 17/501; B65D 17/50; B65D 43/0218; B65D 43/0214; B65D 41/045; B65D 41/0435; B65D 53/04; B65D 81/266; B65B 7/2878; B65B 7/2842; B65B 7/164; B65B 7/2835; B65B 51/227; B65B 55/19

USPC ..... 53/471, 478, 477, 476; 215/232, 344, 215/343, 341, 316, 349, 351, 347; 220/359.4, 359.3, 359.1, 803, 802, 801

See application file for complete search history.

(56) References Cited

U.S. PATENT DOCUMENTS 2,937,481 A * 5/1960 Palmer ..... 53/471
3,460,310 A 8/1969 Adcock et al.

(Continued)

FOREIGN PATENT DOCUMENTS

| | | |
|---|---|---|
| EP | EP2014461 B1 | 7/2009 |
| EP | EP2077237 A1 | 8/2009 |
| JP | 2000264360 A1 | 9/2000 |

*Primary Examiner* — Robert J Hicks

(74) *Attorney, Agent, or Firm* — Keith L. Jenkins, Registered Patent Attorney, LLC; Keith L. Jenkins

(57) ABSTRACT

Long-term packaging using a combination of an induction seal and a reseal without release layers, both of which are activated by the induction heating process. The exemplary induction seal comprises a laminate of a heat-sealing layer, an aluminum foil layer, and a foam backing. The exemplary reseal comprises a low-density polyethylene foam core sandwiched between first and second layers of solid low-density polyethylene film. The reseal deforms during the induction heating process to be shaped to engage the outer and inner peripheral surfaces of the finish, so that the reseal is hermetic even after the induction seal is removed. Preferred containers are PETE with PP compression closures. Replaceable desiccant and oxygen scavengers may be used with food or other contained material. Precise timing of induction heating is required to achieve the desired result.

20 Claims, 7 Drawing Sheets

(56) References Cited

U.S. PATENT DOCUMENTS

| | | | | | |
|---|---|---|---|---|---|
| 3,516,567 | A | * | 6/1970 | Hemphill | 206/204 |
| 3,928,109 | A | * | 12/1975 | Pollock et al. | 156/69 |
| 4,094,460 | A | | 6/1978 | Scanga et al. | |
| 4,588,099 | A | * | 5/1986 | Diez | 215/232 |
| 4,683,016 | A | * | 7/1987 | Dutt et al. | 156/69 |
| 4,778,698 | A | * | 10/1988 | Ou-Yang | 428/34.4 |
| 4,934,544 | A | * | 6/1990 | Han et al. | 215/232 |
| 5,381,913 | A | | 1/1995 | Peeters | |
| 5,667,089 | A | | 9/1997 | Moore | |
| 5,720,401 | A | * | 2/1998 | Moore | 215/232 |
| 6,082,566 | A | | 7/2000 | Yousif et al. | |
| 6,131,754 | A | | 10/2000 | Smelko | |
| 6,474,490 | B1 | * | 11/2002 | Seibel et al. | 215/232 |
| 6,902,075 | B2 | | 6/2005 | O'Brien et al. | |
| 6,974,045 | B1 | * | 12/2005 | Trombach et al. | 215/232 |
| 7,217,454 | B2 | | 5/2007 | Smelko et al. | |
| 7,648,764 | B2 | | 1/2010 | Yousif | |
| 2003/0010787 | A1 | * | 1/2003 | Dalton et al. | 220/912 |
| 2003/0196418 | A1 | * | 10/2003 | O'Brien et al. | 53/490 |
| 2006/0054584 | A1 | * | 3/2006 | Jackman | 215/347 |

* cited by examiner

LONG-TERM PACKAGING OF FOOD FOR CONSUMER USE

RELATED APPLICATIONS

This application claims the benefit of U.S. Provisional Patent Application 61/378,750 filed Aug. 31, 2010 by the same inventor.

FIELD OF THE INVENTION

This invention relates to seals for food packages that are intended to last for years. The present invention more particularly relates to a re-sealable long term food storage seal. The present invention relates to induction sealing.

BACKGROUND

The consumer market for food packaging for long-term storage has long felt a need for packaging that can be sealed for years, then opened, and then resealed for storage for additional years, without unreasonable risk of food spoilage. Available seals and methods of sealing on rigid plastic packaging do not lend themselves to long-term storage after initial opening of the package. Canned food is not re-sealable for any significant length of time after opening. Glass containers have a high breakage risk. Many ordinary plastic caps used with plastic jars and the like, are permeable to oxygen, unbeknownst to the consumer.

The present inventors encountered the skepticism of experts in developing this invention, and when they asked their commercial sealing company about the method, where told flatly that it was not possible.

U.S. Pat. No. 3,460,310 discloses a method of sealing a container opening using high-frequency induction heating of a membrane that includes a metal foil coated with a thermoplastic material. A resilient pulpboard wad (backing) is disclosed that may be releasably laminated to the foil/thermoplastic seal. Heat deformation of the pulpboard is not disclosed.

U.S. Pat. No. 4,094,460 discloses a plastic sealing ring on a container closure adapted engage the edge of the container opening, and an induction-heated metal foil/thermoplastic film for sealing to the plastic sealing ring. Customized containers and ring seals are required. Induction heating may also be used to seal the plastic sealing ring to a foil layer inside the container. body, requiring further customization of the container.

U.S. Pat. No. 5,381,913 discloses a cap having an induction seal comprising t e layers (top to bottom) of low-density polyethylene foam, wax, paper, foil, paper, wax, PET, and low-density polyethylene film. The dual releasing layers (wax) are absorbed into the adjacent paper layers upon heating. The releasing layers are not equally strong, so the aluminum foil remains on the container at first opening.

U.S. Pat. No. 5,667,089 discloses a closure with a peripheral well it the inner top surface. The inner well has integral flexible teeth which with the well compress a seal liner to wrap around the land of the container. The liner may be a heat-induction liner, which is used without a compression layer.

U.S. Pat. No. 6,082,566 discloses a re-sealable liner and induction seal made in layers (top to bottom) of support material, adhesive, foil, adhesive, polymer, adhesive, synthetic fabric, wax, thermoplastic film, adhesive, and heat sealant film and providing a transparent primary seal (the thermoplastic film, adhesive, and heat sealant film) with a resealing liner (support material, adhesive, foil, adhesive, polymer, adhesive, and synthetic fabric that has absorbed the wax). The wax is a releasing layer.

U.S. Pat. No. 6,131,754 discloses a two-piece induction seal made in layers (top to bottom) of synthetic foam, synthetic polymer, wax, metallic foil, and heat-activated polymer adhesive. The wax is a releasing layer.

U.S. Pat. No. 6,902,075 discloses a one-component tabbed seal and wadding system for a screw cap made in layers (top to bottom) of cardboard, low-density polyethylene film, a nitro-cellulose release layer, PET film, polymeric adhesive, PET tab, polyethylene foam, polymeric adhesive, aluminum foil, and hot-melt adhesive.

U.S. Pat. No. 7,217,454 discloses a tabbed seal made of layers (top to bottom) of PET film, EVA foam, a tab release strip, a release material, polyethylene foam, aluminum foil, PET film, and heat-activated sealant.

U.S. Pat. No. 7,648,764 discloses two-piece seals featuring ultrasonically welded adjacent thermoplastic film layers.

European Patent EP2013461 discloses a on-releasing seal made of layers (top to bottom) of plastics film, plastics foam adhesive, foam, foam/foil adhesive, metal foil, and heat seal. The foam and metal foil remain attached to aid recycling.

U.S. Pat. No. 5,143,763 discloses an oxygen scavenger which may be attached to the inside of a container or closure.

European Published Patent Application EP2077237 discloses a container including an EVOH layer on the inner surface and a solid desiccant attached to the interior of the container.

Patent Abstracts of Japan publication number 2000-264360 describes an oxygen-absorbing container cover including a composition of polyolefin and oxygen absorbent sandwiched between polyolefin films.

Sealing methods and materials that provide packaging impermeable to oxygen infiltration after initial sealing and after opening and re-closing are needed. A need exists for a way to scavenge oxygen inside the food container that is safe for food, and that is effective for initial packaging and after the package has been opened and then closed again.

OBJECTS AND FEATURES OF THE INVENTION

A primary object and feature of the present invention is to overcome the above-mentioned problems and fulfill the above-mentioned needs.

Another object and feature of the present invention is to provide a method for sealing a package that creates a seal that is substantially impermeable to oxygen infiltration. Another object and feature of the present invention is to provide a closure that is substantially impermeable to oxygen infiltration when initially induction sealed. Another object and feature of the present invention is to provide a closure that is substantially impermeable to oxygen infiltration when manually closed after the induction seal has been broken. Another object and feature of the present invention is to provide a closure that has a reseal that conformably shapes to engage the finish of the container during heat-sealing the induction seal. Another object and feature of the present invention is to provide a method for scavenging oxygen inside a food package during initial packaging. Another object and feature of the present invention is to provide a method for scavenging oxygen inside a food package after the package has been opened and reclosed.

It is an additional primary object and feature of the present invention to provide a method of packaging that is safe, inexpensive, easy to clean, and handy. Other Objects and features of this invention will become apparent with reference to the following descriptions.

SUMMARY OF THE INVENTION

In accordance with a preferred embodiment hereof, the present invention provides methods for long-term packaging of food for consumer use. The method provides for an induction seal including a metallic (preferably aluminum) layer sandwiched between a sealing layer and a foam backing layer, as well as a reseal including a layer of low-density polyethylene foam sandwiched between two non-foam layers of low density polyethylene film. No releasing layers are employed, and the foam backing of the induction seal does not stick to the low-density polyethylene foam of the reseal. In operation, the induction seal is placed against the container opening with the sealing layer in contact with the jar opening. The reseal is placed on top of the induction seal and the cap is screwed down tight. An induction sealer is used to melt the sealing layer onto the container opening edge (the "finish") and to deform the reseal for wrapping around the inner and outer periphery of the container opening edge. Precise control of the power and the timing of the induction sealing electromagnet is required to accomplish this. Once sealed, the reseal layer remains in the cap and the induction seal remains on the container opening. Oxygen scavenging packets, containing iron filings in an oxygen-permeable membrane, are placed in the package with the food before sealing. After first opening and induction seal removal, the reseal will provide hermetic sealing on re-closing.

The package and cap are preferably made of PETE, for low permeability to oxygen, long-term resilience, and transparency.

The invention provides a method of making a hermetically sealed and hermetically resealable long-term storage container including the steps of: providing a three-layer induction seal on a finish of a container; providing a three-layer reseal in a compression closure for the container; dosing the compression closure on the container; and applying induction heating to the three-layer induction seal to transfer heat to the three-layer reseal for a predetermined time responsive to a size of the container. The method, further including the step of providing food in the container prior to the step of closing the compression closure on the container. The method, further including the step of providing an oxygen scavenger in the container prior to the step of closing the compression closure on the container. The method, further including the step of providing a desiccant in the container prior to the step of closing the compression closure on the container. The method, further including the step of providing an electromagnetic induction sealer prior to the step of applying induction heating to the three-layer induction seal to transfer heat to the three-layer reseal for a predetermined time responsive to the size of the container. The method, further including the step of providing a material to be stored in the container prior to the step of closing the compression closure on the container. The method, where the predetermined time is sufficient to cause the reseal to deform to form an annular groove operable to engage at least a portion of an outer perimeter surface of the finish of the container after removal of the induction seal by a user. The method, where the predetermined time is sufficient to cause the reseal to deform to form an annular groove operable to engage at least a portion of an inner perimeter surface of the finish of the container after removal of the induction seal by a user. The method, where the induction heating is applied using a 600-watt induction sealer and the predetermined time is one of: 1/0 seconds +/−0.2 second for 110 mm lids on 128 oz. & 64 oz, containers; 0.9 seconds +/−0.3 seconds for 89 mm lids on 32 oz. containers; and 0.85 seconds +/−0.25 second for 63 mm lids on 16 oz. containers. The method, where; the container includes polyethylene terephthalate; the compression closure includes polypropylene; the three-layer induction seal includes a heat-seating layer, a metallic foil layer, and a foam backing; and he three-layer reseal includes a low-density polyethylene foam core sandwiched between first and. second layers of solid low-density polyethylene film.

A product made by a method of making a hermetically seated and hermetically resealable long-term storage container including the steps of: providing a three-layer induction seal on a finish of a container; providing a three-layer reseal in a compression closure for the container; closing the compression closure on the container; and applying induction heating to the three-layer induction seal to transfer heat to the three-layer reseal for a predetermined time responsive to a size of the container. The product, further including an annular groove in the reseal operable to engage at least a portion of at least one of an outer perimeter surface of the finish of the container and an inner perimeter surface of the finish of the container after removal of the induction seal by a user, The product, further including at least one of a replaceable oxygen scavenger and a replaceable desiccant in the container. The product, further including a material to be stored in the container. The product, where; the container includes polyethylene terephthalate; the compression closure includes polypropylene; the three-layer induction seat includes a heat-sealing layer, a metallic foil layer, and a foam backing; and the three-layer reseal includes a tow-density polyethylene foam cork. sandwiched between first and second layers of solid low-density polyethylene film.

A kit for assisting in making a long-term storage container, the kit including: at least one three-layer induction sealing material including a laminate of a heat-sealing layer, a metallic foil layer, and a foam backing; at least one three-layer resealing material including a laminate of low-density polyethylene foam core sandwiched between first and second layers of solid low-density polyethylene film; and a set of instructions for using the three-layer induction sea material and the three-layer resealing material together according to the method. The kit, where the at least one three-layer induction sealing material and the at least one three-layer resealing material comprise a plurality of discs sized to be used according to the method on at least one size of container. The kit, further including at least one compression closure sized to be used with the plurality of discs according to the method. The kit, further including at least one container sized to be used with the plurality of discs and the at least one compression closure. The kit, further including at least one induction sealer.

BRIEF DESCRIPTION OF THE DRAWINGS

The above and other objects and advantages of the present invention will become more apparent from the following description taken in conjunction with the following drawings in which.

DETAILED DESCRIPTION OF THE BEST MODES AND PREFERRED EMBODIMENTS OF THE INVENTION

Figure 1:
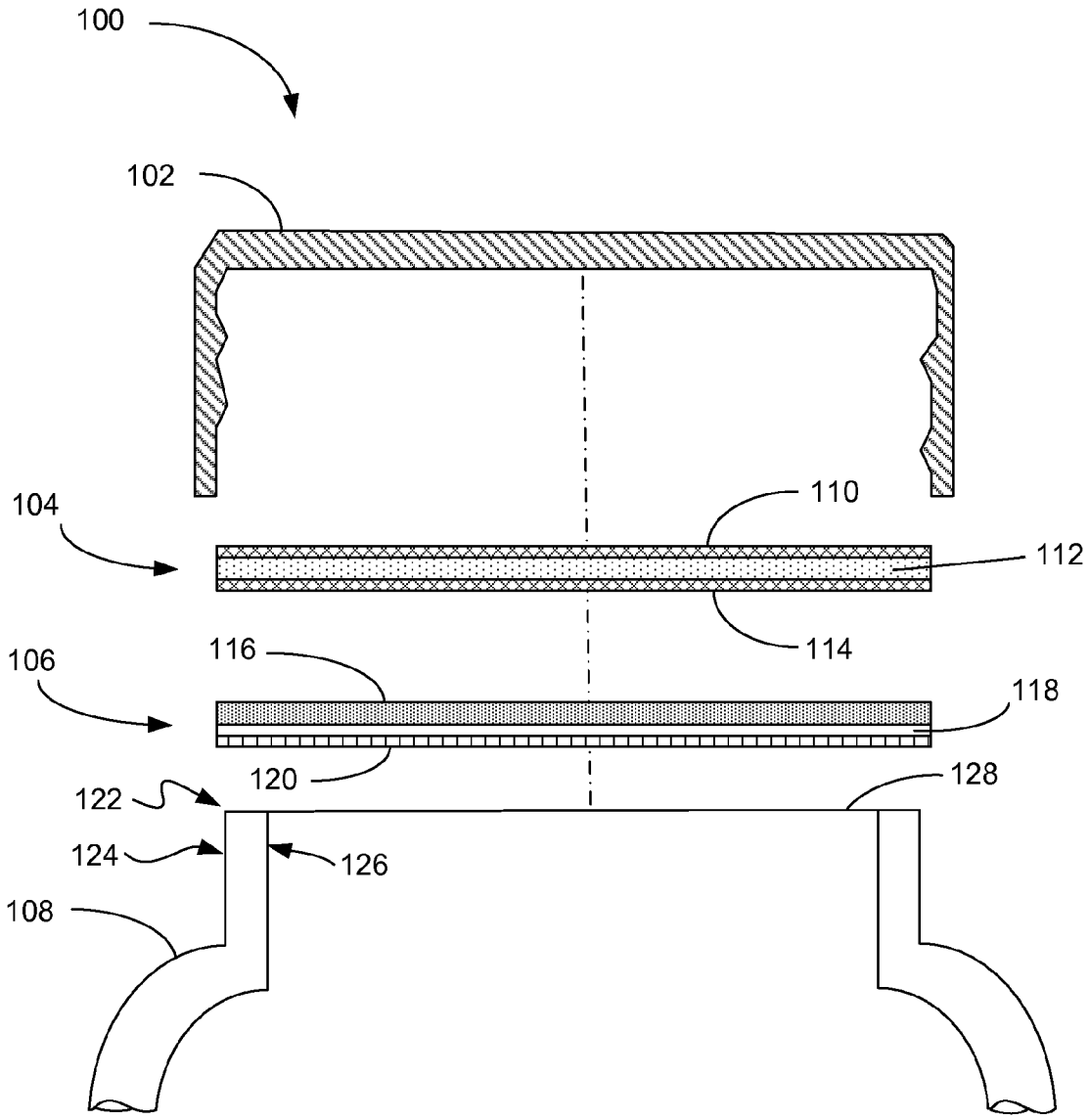
FIG. 1 is a front elevation exploded view illustrating an exemplary induction seal and reseal before induction sealing, according to a preferred embodiment of the present invention.

FIG. 1 is a front elevation exploded view illustrating an exemplary induction seal 106 and reseal 104 before induction sealing, according to a preferred embodiment 100 of the present invention. The container 108 is shown truncated, The finish 122 of container 108 receives a disc-shaped induction seal 106, which comprises a heat sealing layer 120, aluminum foil layer 118, and foam backing 116. In various alternate embodiments, metals other than aluminum, including aluminum alloys, may be used. Container 108 is preferably made of polyethylene terephthalate (PETE) which provides good resistance to oxygen infiltration and breakage. In some alternate embodiments, container 108 may be made of other suitable materials. The three layers 116, 118, 120 are preferably attached in a single induction seal, as shown (not to scale). For example, and without limitation, FoilSeal™, available from Priority Plastics, Inc., of Forrest, Illinois, may be used as the induction seal 106.

Disc-shaped reseal 104 also includes three layers: a low-density polyethylene foarn Core 112 sandwiched between first and second layers of solid low-density polyethylene film 110, 114. The three layers 110, 112, 114 are preferably attached in a single reseal 104, as shown (not to scale), For example, and without limitation, TriSearg@F-217 from Tekni-Plex company in Blauvelt, N.Y., may be used as a reseal 104. Reseal 104 is heat-deformable, especially under the pressure of a closed compression closure 102, and will form an annular groove 502 (see FIG. 5) engaging the inner 126 and outer 124 peripheral surfaces of the finish 122.

Cap 102 is preferably made of polypropylene (PP), which provides good resistance to oxygen infiltration and breakage and is recyclable. In various embodiments, other materials may be used for cap 102. Cap 102 receives reseal 104 and the top rim 128 of finish 122 of container 108 receives induction seal 106. In various alternate embodiments, cap 102 may be various types of compression closures.

Figure 2:
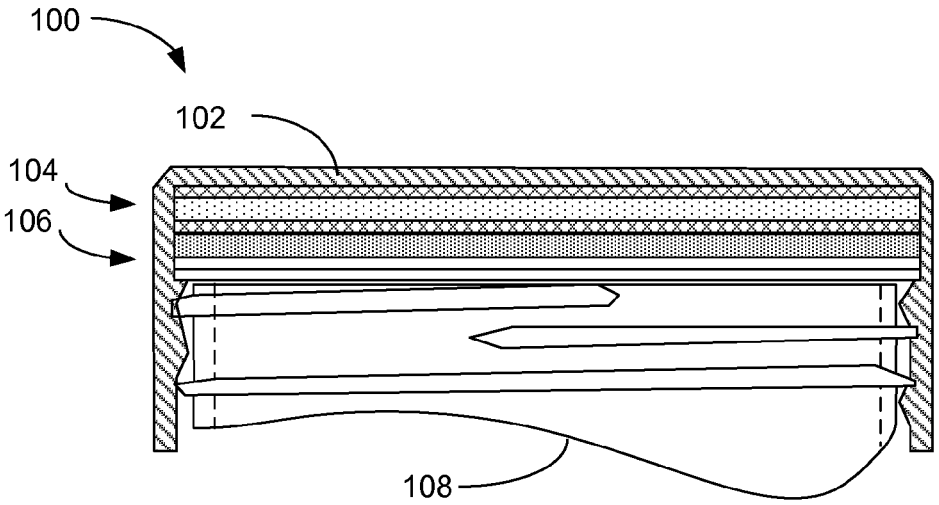
FIG. 2 is a front elevation cutaway view illustrating the exemplary induction seal and reseal in preparation for induction sealing, according to the preferred. embodiment of the present invention of FIG. 1.

FIG. 2 is a front elevation cutaway view illustrating the exemplary induction seal 106 and reseal 104 in preparation for induction sealing, according to the preferred embodiment 100 of the present invention shown in FIG. 1. Cap 102 is compressively applied to the finish 122 of container 108, compressing induction seal 106 and reseal 104 between the cap 102 and the rim 128 of the finish 122 of container 108. In the embodiment shown, a screw cap 102 and finish 122 are used to supply compression. In various embodiments, other types of compression closures may be used for cap 102.

Figure 3:
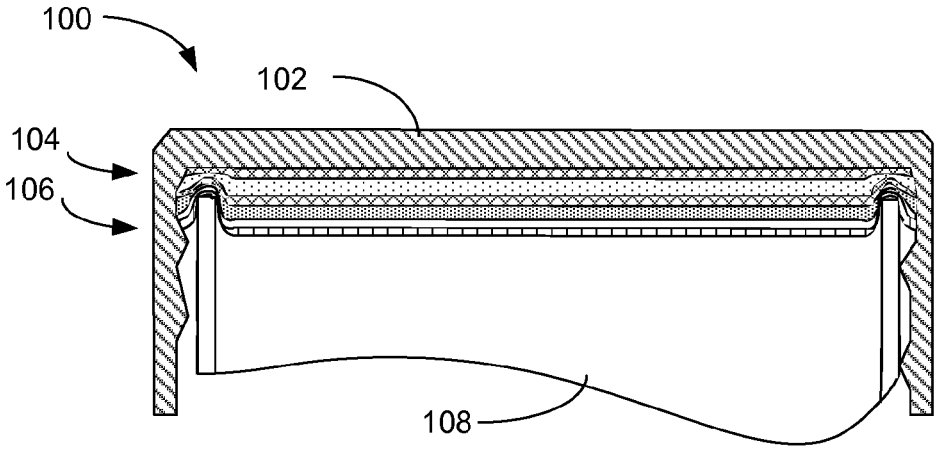
FIG. 3 is a cross-sectional view illustrating the exemplary induction seal and reseal after induction sealing, according to the preferred embodiment of the present invention of FIG. 1.

FIG. 3 is a cross-sectional view illustrating the exemplary induction seal and reseal after induction sealing, according to the preferred embodiment 100 shown in FIG. 1. The combination of compression from compression cap 102 and heat generated by an induction sealing machine for a precise interval at a precise power, causes the heat sealing layer 120 of the induction seal 106 to seal to the finish 122 of container 108, and the foam backing layer 116, foam core 112, and the solid polyethylene layers 110, 114 compress and deform, causing the induction seal 106 and reseal 104 to form around the exterior 124 and interior 126 perimeter surfaces of the rim 128 of the finish 122 of container 108. The reseal 104 deforms because of heat transferred from the induction seal 106. This provides an excellent hermetic seal for keeping food fresh. Induction seal 106 and reseal 104 are not connected, either before or after induction sealing, No release layer is used, which provides an economic advantage.

In order to deform the reseal 104 without overheating the induction seat 106, precise control of the timing of the induction seating process is required, An exemplary induction sealer suitable for the purpose is a 600-watt manual induction sealer 60-130 mm 220 volts available from Triton Packaging of Florida (tritonpackaging.com). Using a particular exemplary induction sealer, exemplary times for applying power are:

110 mm lids on 128 oz. & 64 oz. jars=0.9 seconds +/−0.1 second 89 mm lids on 32 oz. jars=0.7 seconds +/−0.1 second 63 mm lids on 16 oz. jars=0.7 seconds +/−0.1 second The present inventors found these power and time combinations by extensive experimentation, despite the skepticism of experts, to fill a long-felt need in their long-term food storage business. Using another particular exemplary induction sealer of the same model from the same manufacturer, the exemplary times for applying power are:

110 mm lids on 128 oz, & 64 oz. jars=1.2 seconds +1/−0.2 seconds 89 mm lids on 32 oz. jars=1.05 seconds +/−0.15 second 63 mm lids on 16 oz. jars=0.9 seconds +/−0.2 second.

The variation in best times between particular 600-watt manual induction sealers indicates a need for minor experimentation for each seater, with the numbers given above providing excellent starting ranges.

Figure 4:
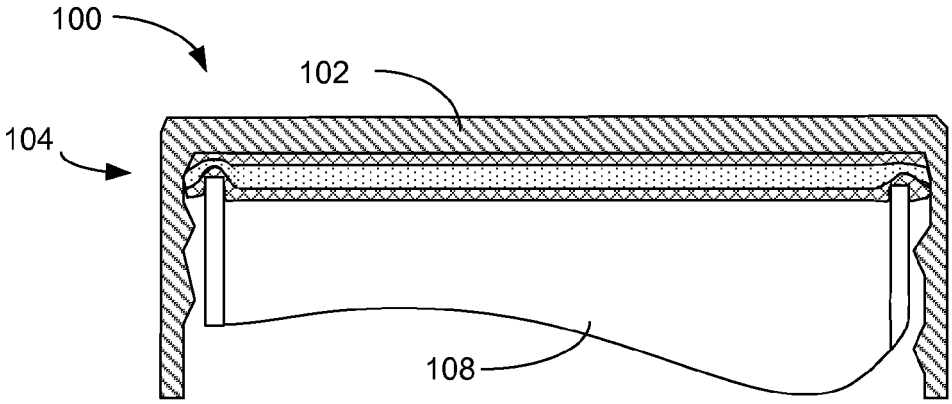
FIG. 4 is a cross-sectional view illustrating the exemplary reseal after removal of the induction seal, according to the preferred embodiment of the present invention of FIG. 1.

FIG. 4 is a cross-sectional view illustrating the exemplary reseal 104 after removal of the induction seal 106, according to the preferred embodiment 100 shown in FIG. 1. The induction sealing process described above creates an annular groove 502 (see FIG. 5) n the reseal 104, which engages at least a portion of the inner 126 and outer 124 perimeter surfaces of the rim 128 of the finish 122 of container 108, thereby creating a reseal that is as effective at hermetic seating as the original induction seal 106, Accordingly, the container 108 may be reopened and closed repeatedly over a number of years while preventing oxygen infiltration between openings. The novel method may be used beneficially by the food industry, survivalists, civil defense systems, and scientists, For non-limiting example, such resealable containers 100 are effective for containing wooden archaeological specimens and other scientific specimens that must be isolated from oxygen and moisture, but must occasionally be removed for study.

In addition to food or other contents, the resealable container may house one or more replaceable oxygen scavenger packets 1104 and/or moisture scavenging packets 1106 (see FIG. 11), which will take up oxygen and/or moisture, respectively, introduced at initial sealing and, optionally, at reopening, The packets 1104 and/or 1106 may be replaced from time to time when the container 108 is reopened for other purposes. Replacing the oxygen scavenger 1104 requires the addition of a pressure seal to reinforce the cap 102. Otherwise, the scavenging of oxygen in the hermetically resealed container 108 causes a significant reduction in air pressure within the container 108, resulting in the inward bowing of the cap 102. The pressure seal is a paper disc with adhesive on one side, The disc is placed on the rim 128 of the finish of the container with the adhesive side down to reinforce the cap 102 which is fastened thereon.

Figure 5:
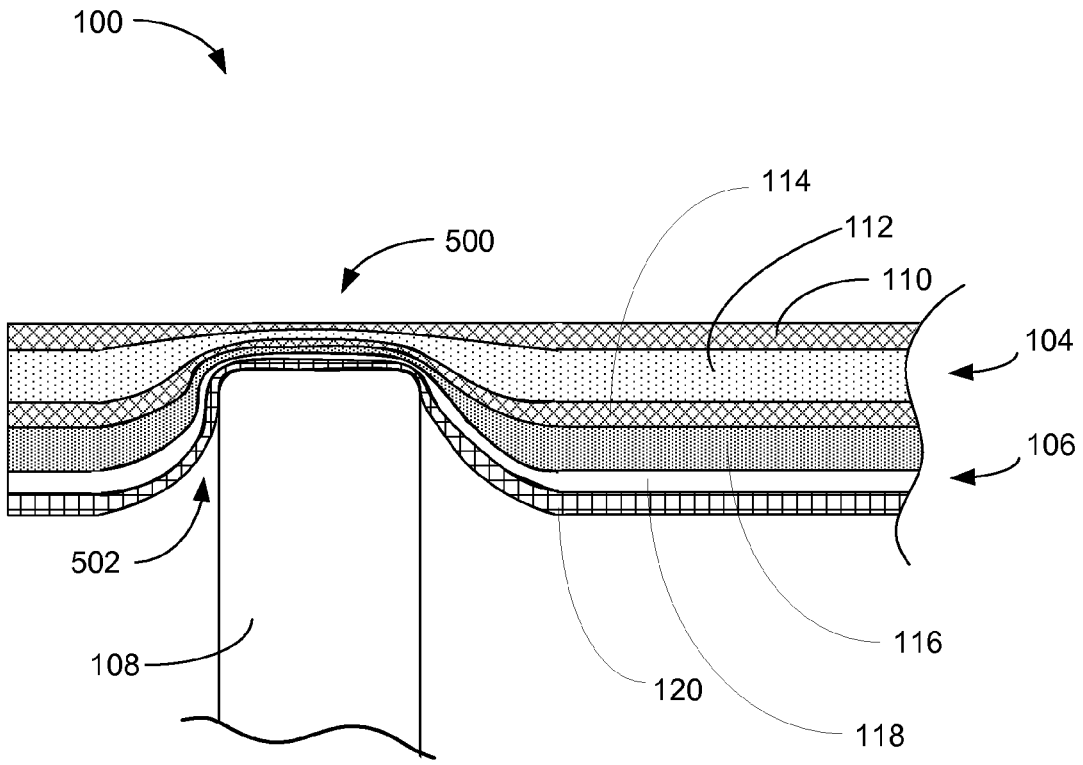
FIG. 5 is a cross-sectional view illustrating a detail of the exemplary induction seal and reseal after induction sealing, according to the preferred embodiment of the present invention of FIG. 1.

FIG. 5 is a cross-sectional view illustrating a detail of the exemplary induction seal 106 and reseal 104 after induction sealing, according to the preferred embodiment of the present invention of FIG. . The foam layers 112 and 116 undergo the most combined compression and heat deformation, while the heat sealing layer undergoes the adhesive deformation proximate 500 the finish 12 of the container 108. The solid polyethylene layers 110 and 114 also undergo some deformation, the whole forming an annular groove 502 in the reseal 104.

Figure 6:
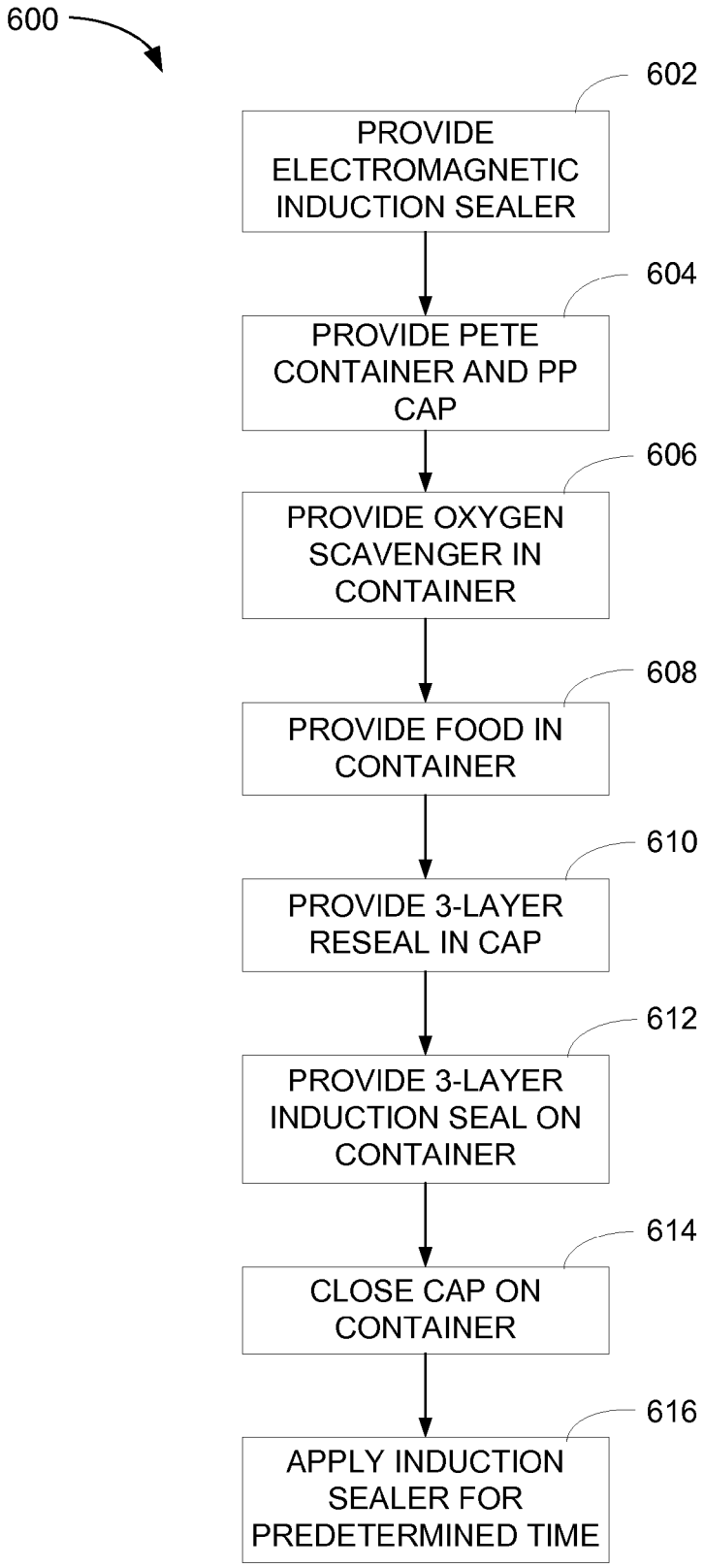
FIG. 6 is a process diagram illustrating an exemplary process of making a resealable induction seal, according to a preferred embodiment of the present invention.

FIG. 6 is a process diagram illustrating an exemplary process 600 of making a resealable induction seal 104, 106, according to a preferred embodiment 100 of the present invention. In step 602, an electromagnetic induction seater is provided, such as the exemplary induction sealer discussed above. In step 604, a PETE container 108 and PP cap 102 are provided. In optional step 606, an oxygen scavenger 1104 and/or a desiccant 1106 (See FIG. 11) is placed in the container 108. In step 608, the food or other contents are placed in container 108. In a particular embodiment, steps 606 and 608 may be reversed. In step 610, the reseal 104 is placed in cap 102. In step 612, the induction seal is received on the rim 128 of the finish 122 of container 108. An alternate embodiment of step 612 places the induction seal 106 in the cap 102 after the reseal 104 is placed in the cap 102. In step 614, the cap 102 is closed on container 108, compressing reseal 104 and induction seal 106. In novel step 616, the induction sealer is applied onto the cap 102, concurrently applying induction heating to the reseal 104 and the induction seal 106 (from the induction seat) for the predetermined times provided above. White a single induction sealer is exemplified here, those of skill in the art, enlightened by the present disclosure, will appreciate that the method 600 may be carried out using many induction sealers simultaneously on a large industrial scale.

Figure 7:
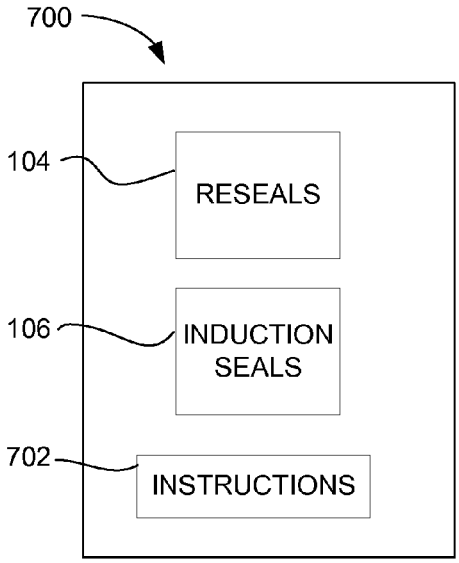
FIG. 7 is a diagram illustrating a first exemplary kit for assisting in the practice of the exemplary method of FIG. 6, according to a preferred embodiment of the present invention.

FIG. 7 is a diagram illustrating a first exemplary kit 700 for assisting in the practice of the exemplary method 600 of FIG. 6, according to a preferred embodiment of the present invention. One or more reseals 104 and an equal number of induction seals 106 may be sold as a kit, The seals may be sold as a plurality of discrete, disc-shaped seals 104, 106 or as sheet material to be cut by the recipient. instructions 702 describe the use of the seals 104, 106 according to method 600.

Figure 8:
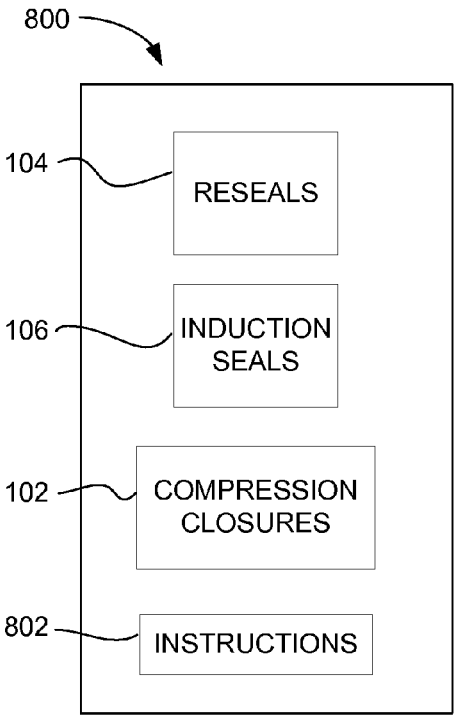
FIG. 8 is a diagram illustrating a second exemplary kit for assisting in the practice of the exemplary method of FIG. 6, according to a preferred embodiment of the present invention.

FIG. 8 is a diagram illustrating a second exemplary kit 800 for assisting in the practice of the exemplary method 600 of FIG. 6, according to a preferred embodiment of the present invention. One or more compression closures 102 is included corresponding in number and size to the one or more reseals 104 and an equal number of induction seals 106 are provided. instructions 802 describe the use of the seals 104, 106 and compression closures, or caps, 102 according to method 600.

Figure 9:
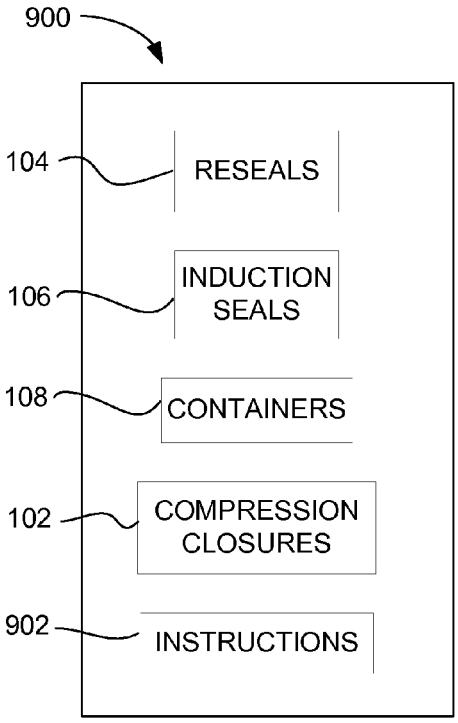
FIG. 9 is a diagram illustrating a third exemplary kit for assisting in the practice of the exemplary method of FIG. 6, according to a preferred embodiment of the present invention.

FIG. 9 is a diagram illustrating a third exemplary kit 900 for assisting in the practice of the exemplary method 600 of FIG. 6, according to a preferred embodiment of the present invention. One or more containers 108 and one or more compression closures 102 is included corresponding in number and size to the one or more reseals 104 and an equal number of induction seals 106 that are provided. Instructions 902 describe the use of the seals 104, 106, containers 108, and compression closures, or caps, 102 according to method 600.

Figure 10:
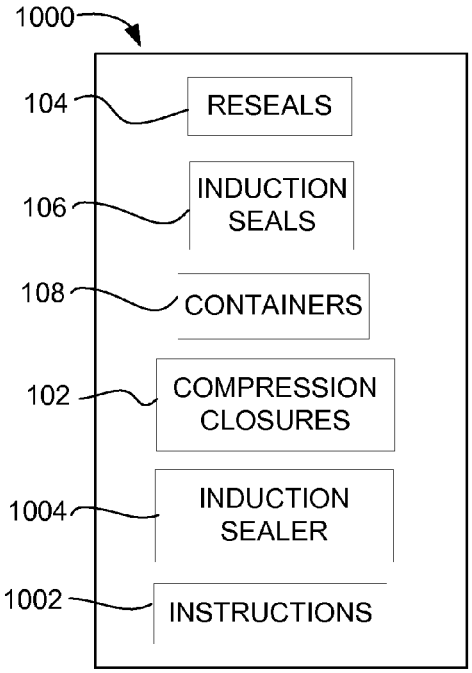
FIG. 10 is a diagram illustrating a fourth exemplary kit for assisting in the practice of the exemplary method of FIG. 6, according to a preferred embodiment of the present invention.

FIG. 10 is a diagram illustrating a fourth exemplary kit 1000 for assisting in the practice of the exemplary method 600 of FIG. 6, according to a preferred embodiment of the present invention, An induction sealer 1004, one or more containers 108 and one or more compression closures 102 is included corresponding in number and size to the one or more reseals 104 and an equal number of induction seals 106 that are provided. Instructions 1002 describe the use of the induction sealer 1002, seals 104, 106, containers 108, and compression closures, or caps, 102 according to method 600.

Figure 11:
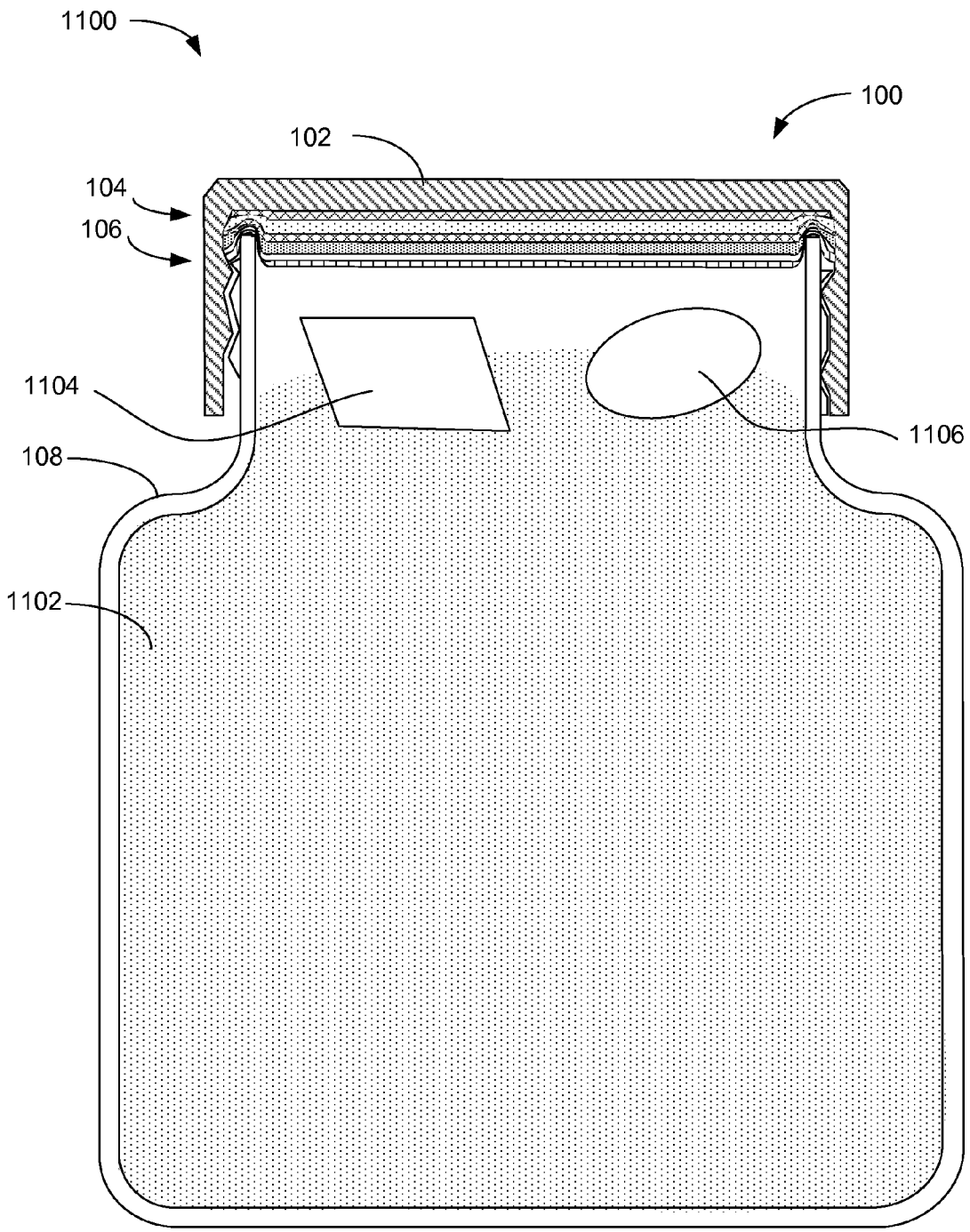
FIG. 11 is a cross-sectional diagram illustrating an exemplary proc ct made by the exemplary process of FIG. 6, according to a preferred embodiment of the present invention.

FIG. 11 is a cross-sectional diagram illustrating an exemplary product 1100 made by the exemplary process 600 of FIG. 6, according to a preferred embodiment of the present invention. Container 108 contains material 1102, a replaceable oxygen scavenger 1104, and a replaceable desiccant 1106. Cap 102 is compressively attached to container 108 and induction seal 106 and reseal 104 have been compressed 614 and induction heated 616.

The method and resulting combination three-layer induction seal and three-layer reseal, without releasing layers, is novel. The deformation of the reseal 104 into an improved, perimeter-engaging seal 104 is a novel feature of the present invention. The formation of the perimeter-engaging reseal 104 does not require specially adapted containers, metal foils on the container finish, nor ring seals: it works well with legacy containers 108 and caps 102, including screw caps and other types of compression closures. Caps and containers with wells, teeth, and other expensive adaptations are not required.

Figure 12:
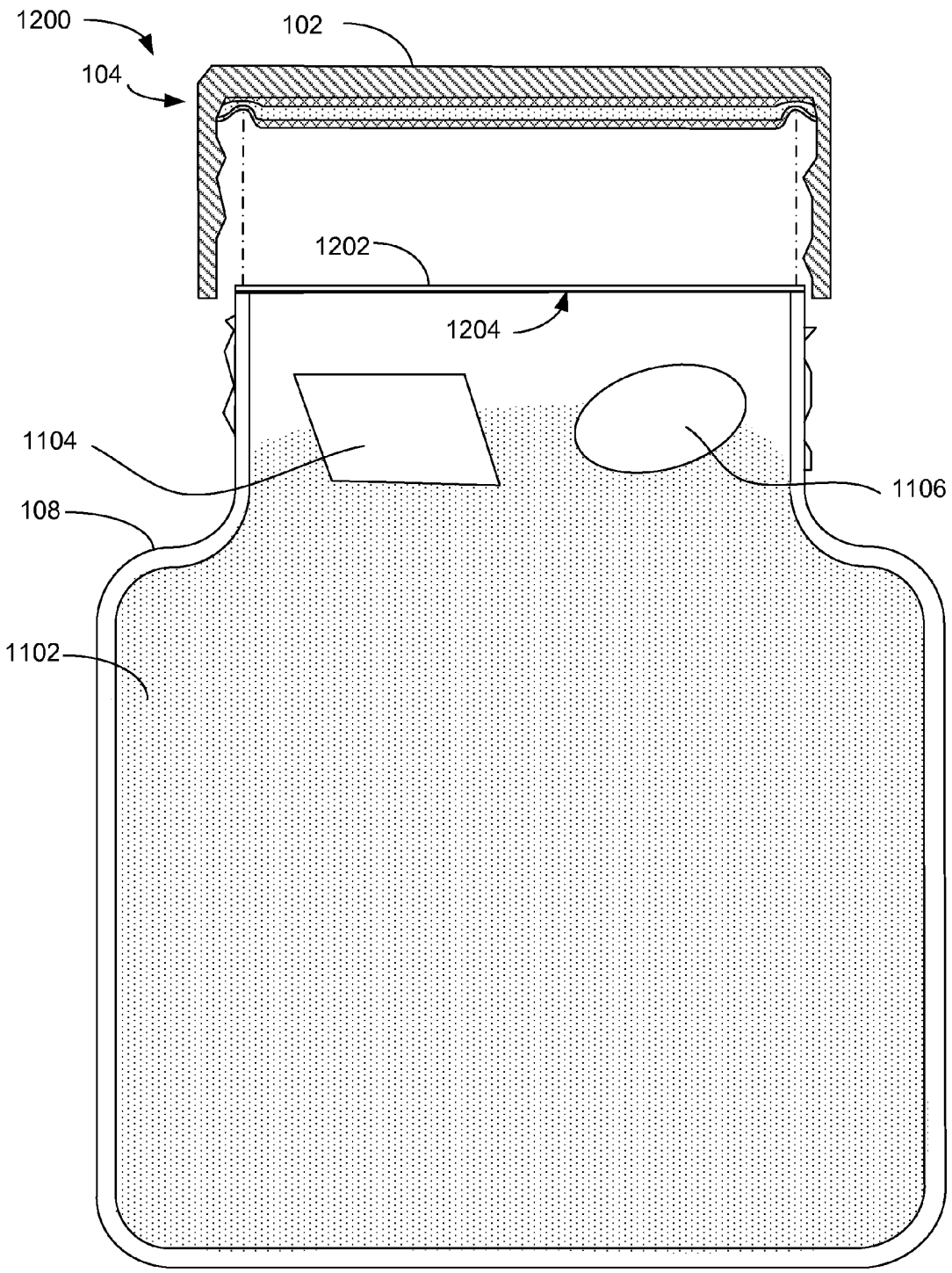
FIG. 12 is a cross-sectional diagram illustrating an exemplary product made by the exemplary process of FIG. 6 being resealed with a replaced oxygen scavenger, according to a preferred embodiment of the present invention.

FIG. 12 is a cross-sectional diagram illustrating an exemplary product 100 made by the exemplary process of FIG. 6 being resealed with a replaced oxygen scavenger 1104, according to a preferred embodiment of the present invention. Replacing the oxygen scavenger 1104 requires the addition of a pressure seal 1202 to reinforce the cap 102. Otherwise, the scavenging of oxygen in the hermetically resealed container 108 causes a significant reduction in air pressure within the container 108, resulting in undesirable inward bowing of the cap 102. The pressure seal 1202 is a paper disc with adhesive on one side 1204. The pressure seal 1202 is placed on the rim 128 of the finish 122 of the container 108 with the adhesive side 1204 down to reinforce the cap 102 which is then fastened to the container 108. In an alternate embodiment, a substantially stronger cap 102 may avoid the need for a pressure seal 1202. However, there is strong economic advantage in using the present invention with legacy containers 108 and caps 102.

While at least one exemplary embodiment has been presented in the foregoing detailed description, it should be appreciated that a vast number of variations exist, It should also be appreciated that the exemplary embodiment or exemplary embodiments are only examples, and are not intended to limit the scope, applicability, or configuration of the invention in any way. Rather, the foregoing detailed description will provide those skilled in the art with a convenient. road map for implementing the exemplary embodiment or exemplary embodiments. It should be understood that various changes can be made in the function and arrangement of elements without departing from the scope of the invention as set forth in the appended claims and the legal equivalents thereof.

I claim:

1. A method of making a hermetically sealed and hermetically resealable long-term storage container comprising the steps of:

a. providing a three-layer induction seal on a finish of a container;

b. providing a three-layer reseal in a compression closure for said container;

c. closing said compression closure on said container; and d. applying induction heating to said three-layer induction seal to transfer heat to said three-layer reseal for a predetermined time responsive to a size of said container.

2. The method of claim 1, further comprising a step of providing food in said container prior to said step of closing said compression closure on said container.

3. The method of claim 1, further comprising a step of providing an oxygen scavenger in said container prior to said step of closing said compression closure on said container.

4. The method of claim 1, further comprising a step of providing a desiccant in said container prior to said step of closing said compression closure on said container.

5. The method of claim 1, further comprising a step of providing an electromagnetic induction sealer prior to said step of applying induction heating to said three-layer induction seal to transfer heat to said three-layer reseal for a predetermined time responsive to the size of said container.

6. The method of claim 1, further comprising a step of providing a material to be stored in said container prior to said step of closing said compression closure on said container.

7. The method of claim 1, wherein said predetermined time is sufficient to cause said reseal to deform to form an annular groove operable to engage at least a portion of an outer perimeter surface of said finish of said container after removal of said induction seal by a user.

8. The method of claim 1, wherein said predetermined time is sufficient to cause said reseal to deform to form an annular groove operable to engage at least a portion of an inner perimeter surface of said finish of said container after removal of said induction seal by a user.

9. The method of claim 1, wherein said induction heating is applied using a 600-watt induction sealer and said predetermined time is one of:

a. 1.0 seconds +/−0.2 seconds for 110 mm lids on 128 oz. & 64 oz. containers;

b. 0.9 seconds +/−0.3 seconds for 89 mm lids on 32 oz. containers; and c. 0.85 seconds +/−0.25 seconds for 63 mm lids on 16 oz. containers.

10. The method of claim 1, wherein;

a. said container comprises polyethylene terephthalate;

b. said compression closure comprises polypropylene;

c. said three-layer induction seal comprises a heat-sealing layer, a metallic foil layer, and a foam backing; and d. said three-layer reseal comprises a low-density polyethylene foam core sandwiched between first and second layers of solid low-density polyethylene film.

11. A hermetically sealed and hermetically resealable long-term material storage container comprising:

a. a hermetic induction seal on a finish of a container, wherein said hermetic induction seal consists of only three layers;

b. a heat-shapeable hermetic reseal in a compression closure for said container, wherein said heat-shapeable hermetic reseal consists of only three layers;

c. said compression closure closed upon said container;

d. a heat induction seal between said three-layer induction seal and said finish of said container; and e. an induction heat-shaped portion of said reseal.

12. The hermetically sealed and hermetically resealable long-term material storage container of claim 11, wherein said induction heat-shaped portion of said hermetic reseal comprises an annular groove in said hermetic reseal operable to hermetically engage at least a portion of at least one of an outer perimeter surface of said finish of said container and an inner perimeter surface of said finish of said container after removal of said induction seal.

13. The hermetically sealed and hermetically resealable long-term material storage container of claim 11, further comprising at least one of a replaceable oxygen scavenger and a replaceable desiccant in material receiving chamber of said container.

14. The hermetically sealed and hermetically resealable long-term material storage container of claim 11, further comprising a material to be stored in said container.

15. The hermetically sealed and hermetically resealable long-term material storage container of claim 11, wherein;

a. said container comprises polyethylene terephthalate;

b. said compression closure comprises polypropylene;

c. said three-layer induction seal comprises a heat-sealing layer, a metallic foil layer, and a foam backing; and d. said three-layer reseal comprises a low-density polyethylene foam core sandwiched between first and second layers of solid low-density polyethylene film.

16. A kit for assisting in making a long-term storage container, the kit comprising:

a. at least one three-layer induction sealing material comprising a laminate of a heat-sealing layer, a metallic foil layer, and a foam backing;

b. at least one three-layer resealing material comprising a laminate of low density polyethylene foam core sandwiched between first and second layers of solid low-density polyethylene film; and c. a set of instructions for using said three-layer induction sealing material and said three-layer resealing material together.

17. The kit of claim 16, wherein said at least one three-layer induction sealing material and said at least one three-layer resealing material comprise a plurality of discs sized to be used on at least one size of container.

18. The kit of claim 17, further comprising at least one compression closure sized to be used with said plurality of discs.

19. The kit of claim 18, further comprising at least one container sized to be used with said plurality of discs and said at least one compression closure.

20. The kit of claim 19, further comprising at least one induction sealer.

* * * * *